US007161539B2

(12) United States Patent
Chang et al.

(10) Patent No.: US 7,161,539 B2
(45) Date of Patent: Jan. 9, 2007

(54) MICROSTRIP REFLECTIVE ARRAY ANTENNA ADOPTING A PLURALITY OF U-SLOT PATCHES

(75) Inventors: The-Nan Chang, Taipei (TW); Yu-Lin Liau, Taipei (TW)

(73) Assignee: Tatung Co., Ltd., Taipei (TW)

( * ) Notice: Subject to any disclaimer, the term of this patent is extended or adjusted under 35 U.S.C. 154(b) by 1 day.

(21) Appl. No.: 11/203,373

(22) Filed: Aug. 15, 2005

(65) Prior Publication Data

US 2006/0145937 A1 Jul. 6, 2006

(30) Foreign Application Priority Data

Dec. 30, 2004 (TW) ..... 93141387 A

(51) Int. Cl.
*H01Q 1/38* (2006.01)

(52) U.S. Cl. ..... 343/700 MS; 343/754; 343/755

(58) Field of Classification Search ..... 343/700 MS, 343/754, 755, 840, 853, 909, 912
See application file for complete search history.

(56) References Cited

U.S. PATENT DOCUMENTS 6,081,234 A * 6/2000 Huang et al. ..... 343/700 MS
6,081,235 A * 6/2000 Romanofsky et al. ..... 343/700 MS
6,384,787 B1 * 5/2002 Kim et al. ..... 343/700 MS
6,441,787 B1 * 8/2002 Richards et al. ..... 343/700 MS
6,861,987 B1 * 3/2005 Chang et al. ..... 343/700 MS
7,026,998 B1 * 4/2006 Chang et al. ..... 343/700 MS

* cited by examiner

*Primary Examiner*—Tho Phan
(74) *Attorney, Agent, or Firm*—Bacon & Thomas, PLLC

(57) ABSTRACT

The present invention relates to a microstrip reflective array antenna adopting a plurality of U-slot patches. The microstrip reflective array antenna comprises a reflective disk, a horn antenna and a support. The reflective disk is adapted to reflect microwave signals wherein a plurality of square patches are disposed on the upper surface of a first substrate and a plurality of U-slot patches corresponding to the square patches are disposed on the upper surface of a second substrate. In addition, the lower surface of the first substrate is stacked on the upper surface of a second substrate. The horn antenna is adapted to receive the microwave signals from the reflective disk, and the support is adapted to hold the horn antenna directly above the reflective disk.

7 Claims, 4 Drawing Sheets

MICROSTRIP REFLECTIVE ARRAY ANTENNA ADOPTING A PLURALITY OF U-SLOT PATCHES

BACKGROUND OF THE INVENTION

1. Field of the Invention

The present invention relates to a microstrip reflective array antenna and, more particularly, to a microstrip reflective array antenna adopting a plurality of U-slot patches.

2. Description of Related Art

The reflective array antenna has the advantages of being both easy to manufacture and having centralization of reflected microwave signals, thus it is popularly used to receive and transmit microwave signals. As shown in FIG. 1, the U.S. Pat. No. 6,195,047/B1, entitled "Integrated microelectromechanical phase shifting reflective array antenna", discloses a traditional reflective array antenna 10, comprising a traditional circular disk 12 and a horn antenna 16. A plurality of array units 14 of the traditional circular disk 12 reflect microwave signals transmitted from far away, then centralize and reflect the microwave signals to the horn antenna 16, and finally the horn antenna 16 receives the microwave signals. As a result, better signal gain and wider communication band are achieved. As shown in FIG. 2, the plurality of array units 14 can be disposed on the upper surface of the substrate 18 via printed circuit technology. The lower surface of the substrate 18 comprises a grounding layer 19, preferably a metal layer. Due to the necessary gap between the traditional circular disk 12 and the horn antenna, a support extends therebetween, thus retaining and stabilizing the horn antenna 16 on top of the traditional circular disk 12. To attain the purpose of centralizing and reflecting microwave signals, the plurality of array units 14 requires a unique design to reflect the microwave signals to the position of the horn antenna 16. Therefore, the relative positions of the horn antenna 16 and the traditional circular disk 12 must be fixed. As known, when the traditional reflect array antenna 10 transmits microwave signals, they are transmitted by the horn antenna 16 and reflected to the far end by the traditional circular disk 12.

To attain the purpose of centralizing and reflecting of microwave signals, the patterns of the plurality of array units 14 are not identical. As shown in FIG. 3, each of array units 141, 142, and 144 comprises a delay line of different length whereas array unit 143 comprises no delay line. The function of the delay line is to adjust the phase of microwave signals to determine the main beam direction in which the array unit 14 reflects, making the microwave signals reflected by the array unit 14 centralize to the horn arena 16.

However, the traditional reflect array antenna 10 has disadvantages such as limited signal gain and narrow communication bandwidth.

SUMMARY OF THE INVENTION

To eliminate the drawbacks of the traditional reflective array antenna, the present invention discloses a microstrip reflective array antenna adopting a plurality of U-slot patches to receive and transmit microwave signals. The microstrip reflective array antenna comprises: a reflective disk for reflecting microwave signals wherein a plurality of square patches are placed on the upper surface of the first substrate, a plurality of U-slot patches are placed on the upper surface of the second substrate, and the lower surface of the first substrate stacking on the upper surface of the second substrate so as to form the reflective disk, and each of the square patches and the U-slot patches corresponds to each other to form an array unit. A horn antenna is adapted to receive and output the microwave signals reflected by the reflective disk. A support is adapted to stabilize the horn antenna directly above the reflective disk.

When the square patches receive microwave signals, due to the square patches being placed on the first and second substrates, the overall substrate has substantial thickness, such that the frequency band of the microwave signals can be effectively enhanced. In addition, the square patches couple the microwave signal electromagnetically to the U-slot patches. Meanwhile, the U-slot patches provide the effect of multiple resonances that further enhance the frequency band of the microwave signals. Due to the increased thickness of the substrate and the multiple resonances, the frequency band of the microwave signals of the array unit can be effectively increased, overcoming the drawbacks of the traditional reflective array antenna.

DETAILED DESCRIPTION OF THE PREFERRED EMBODIMENT

Figure 1:
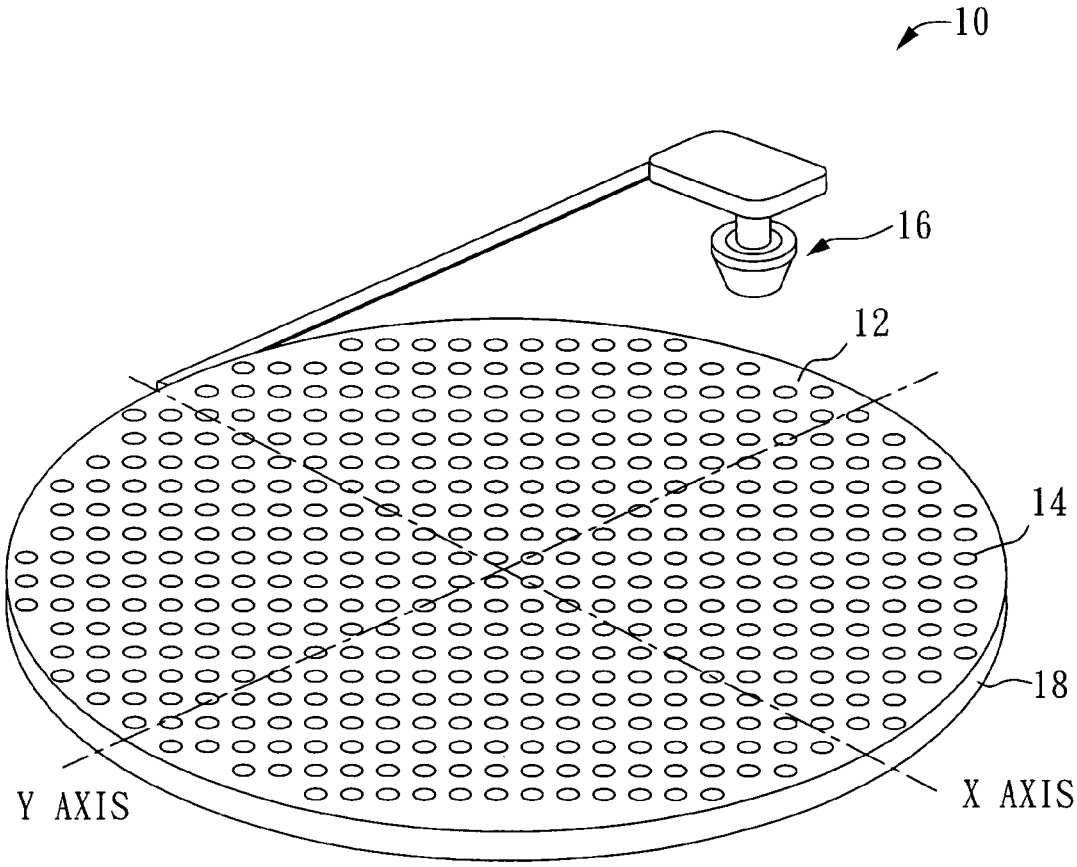
FIG. 1 (PRIOR ART)
FIG. 1 is a diagram of the traditional reflective array antenna.
Figure 2:
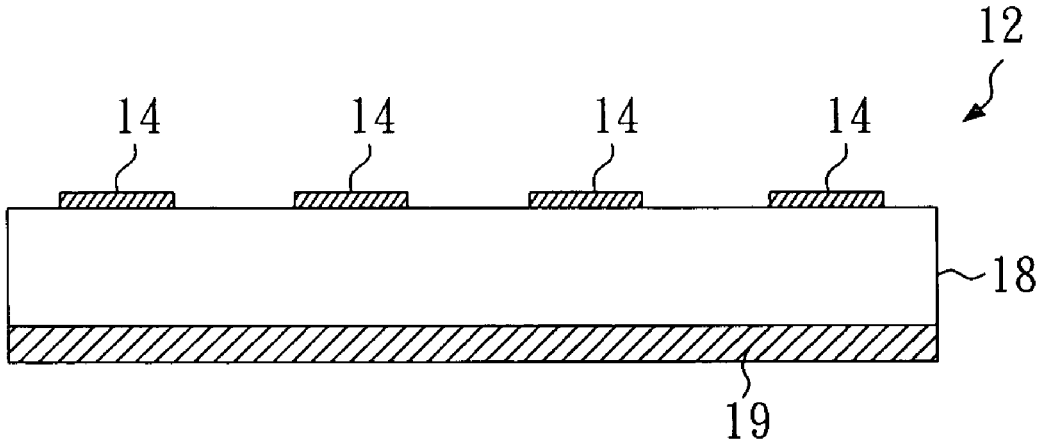
FIG. 2 (PRIOR ART)
FIG. 2 is a lateral view of the traditional reflective array antenna.
Figure 3:
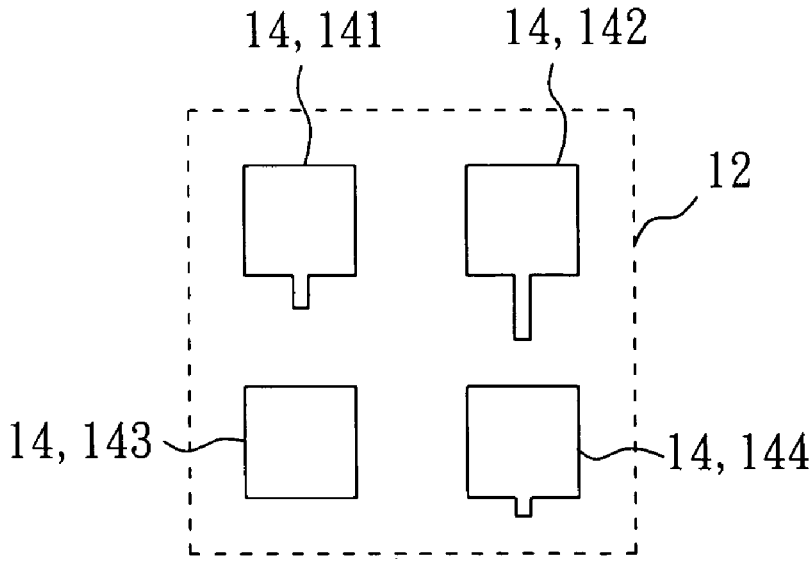
FIG. 3 (PRIOR ART)
FIG. 3 is a diagram of the array unit of the traditional reflective array antenna.
Figure 4:
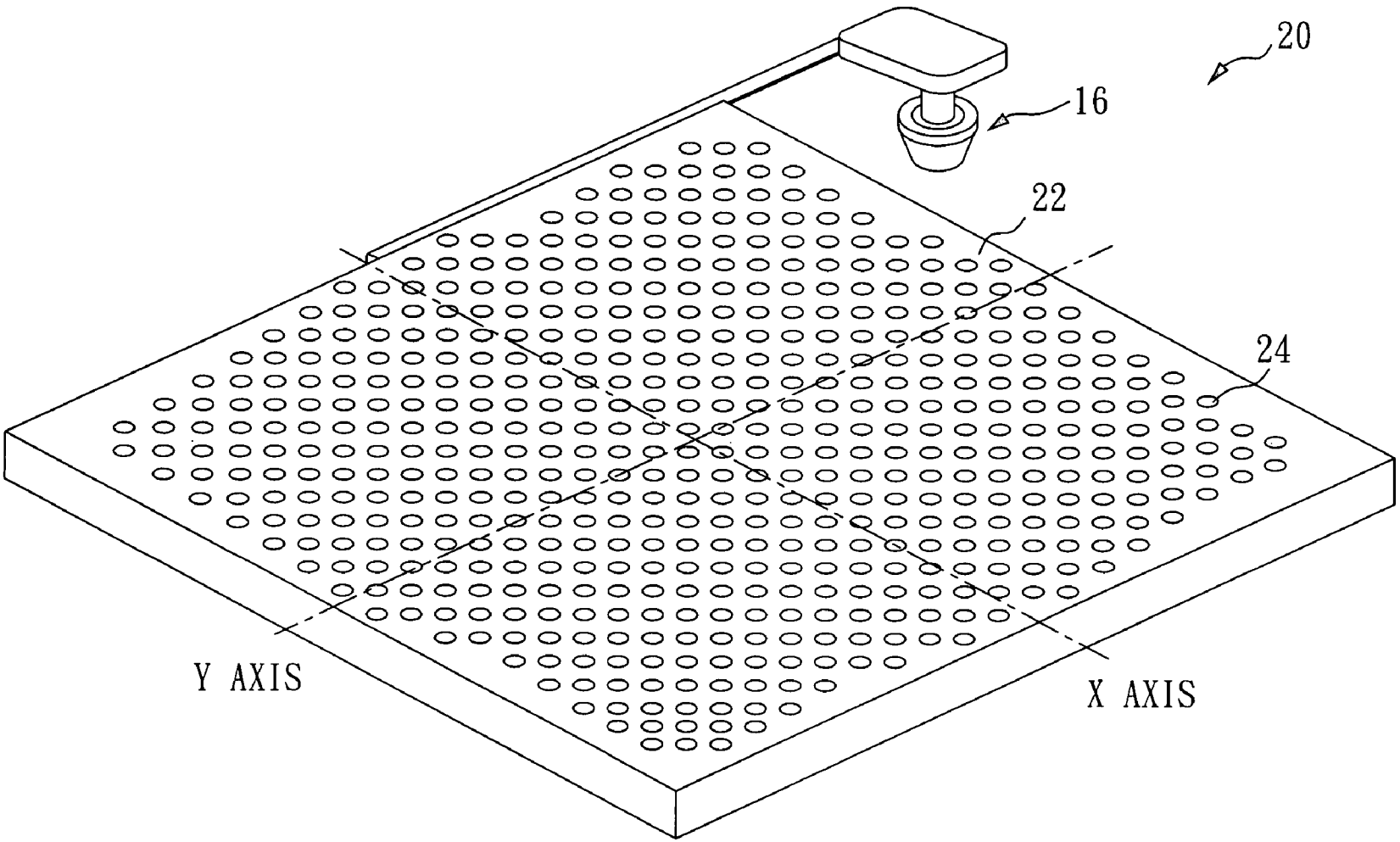
FIG. 4 is a diagram of the microstrip reflective array antenna according to the present invention.

A microstrip reflective array antenna of the present invention and the traditional reflective array antenna are similar in structure, but differences exist in that the array unit of the microstrip reflective array antenna of the present invention uses U-slot patches and further uses the delay line of the U-slot patches to adjust the phase of microwave signal reflected by the array unit. Thus, its structure is still different from that of the array unit of the traditional reflect array antenna 10. As shown in FIG. 4, the microstrip reflective array antenna 20 of the present invention compromises the following elements:

A reflective disk 22, preferably a square disk, but which can also be traditional circular, hexagonal, octagonal, or similarly shaped disks, is provided for reflecting microwave signals from a far end and centralizing and reflecting the microwave signals to a horn antenna 16, or reflecting microwave signals reflected from the horn antenna 16 to the far end.

The horn antenna 16 adapted to receive the microwave signals reflected from the reflective disk 22 of the present invention, or transmits the microwave signals to the reflective disk 22 of the present invention.

A support is provided to stabilize the horn antenna 16 on top of the reflective disk 22 of the present invention. Due to the horn antenna 16 and the support being prior art elements, no further description is deemed necessary.

Figure 5:
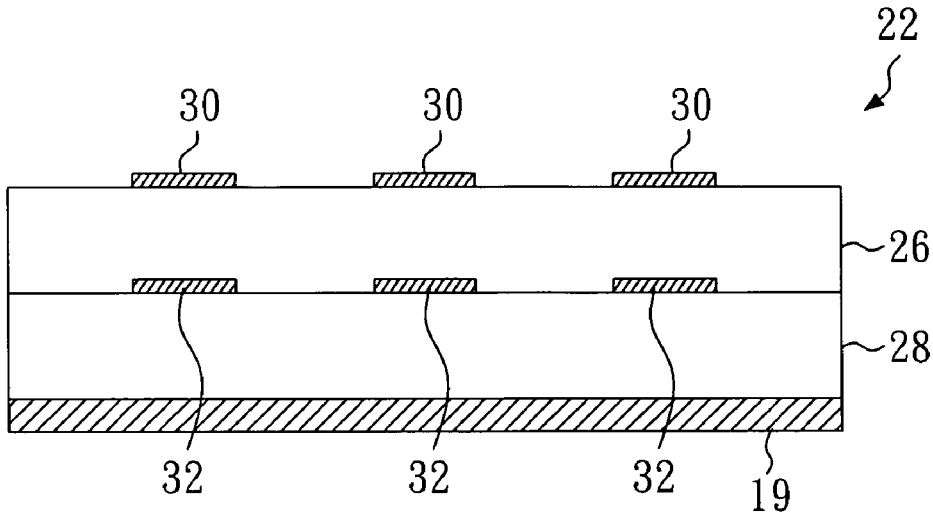
FIG. 5 is a lateral view of the microstrip reflective array antenna according to the present invention.
Figure 6:
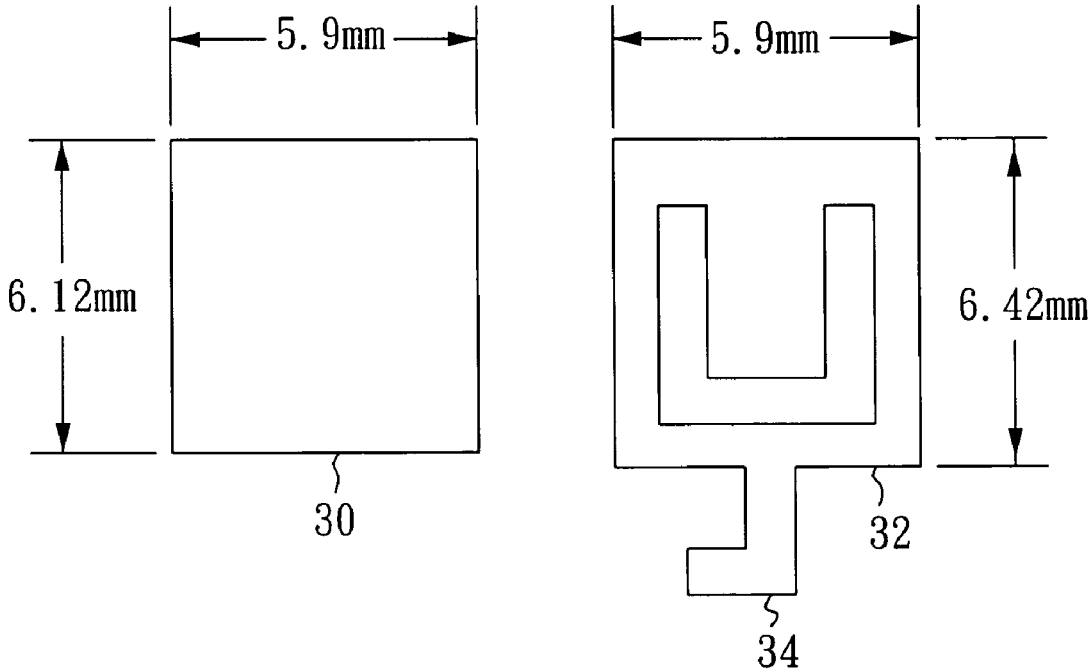
FIG. 6 is a diagram of the array unit of the microstrip reflective array antenna according to the present invention.

As shown in FIG. 5, the reflective disk 22 of the present invention is formed by a first substrate 26 and a second substrate 28. A lower surface of the first substrate 26 can be bonded, pressed, locked, or wedged to be stacked on an upper surface of the second substrate 28. A lower surface of the second substrate 28 comprises the grounding layer, preferably a metal layer 20. Moreover, the materials of the first substrate 26 and the second substrate 28 are preferably Duroid™ or a microsubstrate of FR4 to provide optimum electrical characteristics. The reflective disk 22 of the present invention further comprises a plurality of array units 24. Each array unit 24 includes a square patch 30 and a corresponding U-slot patch 32. The square patch 30 is formed on the upper surface of the first substrate 26 by printed circuit processing. Referring to FIG. 6, the size of the square patch 30 is preferably 5.9 mm*6.12 mm and may be adjusted in accordance with the user's need. The U-slot patch 32, similarly, is formed on the upper surface of the second substrate 28 by printed circuit processing. Moreover, the square patch 30 is preferably placed on top of the U-slot patch 32. The size of the U-slot patch 32 is preferably 5.9 mm*6.42 mm with a U-shaped slot in the center. The sizes of U-slot patch 32 and the U-shaped slot can be adjusted in accordance with the user's need and shall not be restricted. In addition, the U-slot patch 32 further comprises the delay line 34. The shifted phase of microwave signals reflected by every array unit 24 can be modified by adjusting the length and pattern of the delay line 34. Similar effects can be achieved by rotating the U-slot patch 32. Due to the square patch 30 being placed on top of the first substrate 26 and the second substrate 28, the summed thickness is greater than that of the substrate 18. Thus when the square patch 30 receives microwave signals, it can provide microwave signals receiving and reflecting abilities with broader frequency band. Furthermore, the square patch 30 can couple the microwave signal electromagnetically to the U-slot patch 32. In the meantime, the U-slot patch 32 provides the effect of multiple resonances. Therefore, gain of receiving microwave signals is effectively enhanced.

Table 1 compares the difference in the effects of the traditional reflective array antenna 10 and the microstrip reflective array antenna 20 of the present invention. The sizes of the traditional reflective array antenna 10 and the microstrip reflective array antenna 20 are both 20 cm*30 cm, and each comprises 396 array units.

TABLE 1

| | Reflective Array Antenna 10 | Microstrip Reflective Array Antenna 20 |
|---|---|---|
| Center frequency | 11.5 GHz | 10 GHz |
| Signal gain | 22.62 dBi | 20.73 dBi |
| cross polarization level | −24 dB | −25 dB |
| Communication band | 4.3% | 30% |

From Table 1, it is known that when the sizes of the array unit 143 and the square patch 30 are the same, the center frequency (corresponding to the carrier frequency of the microwave signals) of the microstrip reflective array antenna 20 is slightly lower than that of the traditional reflective array antenna 10. However, taking 3 dB as the measuring point of communication band, the microstrip reflective array antenna 20 of the present invention provides a better communication bandwidth.

As illustrated above, the square patch 30 is placed on the first substrate 26 and the second substrate 28, so the summed substrate is thicker, thereby effectively enhancing the frequency band of the microwave signals. Moreover, the square patch 30 can couple the microwave signal electromagnetically to the U-slot patch 32, and the U-slot patch 32 provides multiple resonances that further increase the frequency band of the microwave signals. Due to the increase in thickness and multiple resonances, the frequency band of which the array unit 24 receives microwave signals can be effectively increased. The use of the U-slot patch 32 in the microstrip reflective array antenna 20 of the present invention provides a better communication band, overcoming the drawbacks in the traditional reflect array antenna 10.

Although the present invention has been explained in relation to its preferred embodiment, it is to be understood that many other possible modifications and variations can be made without departing from the spirit and scope of the invention as hereinafter claimed.

What is claimed is:

1. A microstrip reflective array antenna adopting a plurality of U-slot patches to receive and output microwave signals, comprising:

a reflective disk for reflecting microwave signals, wherein a plurality of square patches are placed on an upper surface of a first substrate, a plurality of u-slot patches are placed on an upper surface of a second substrate, and a lower surface of the first substrate stacking on the upper surface of the second substrate so as to form the reflective disk, and each of the square patches and the U-slot patches corresponds to each other to form an array unit;

a horn antenna, adapted to receive the microwave signals reflected from the reflective disk; and a support, adapted to stabilize the horn antenna above the reflective disk.

2. A microstrip reflective array antenna adopting a plurality of U-slot patches as claimed in claim 1, wherein the material of the first substrate or the second substrate is FR4.

3. A microstrip reflective array antenna adopting a plurality of U-slot patches as claimed in claim 1, wherein the material of the first substrate or the second substrate is Duroid™.

4. A microstrip reflective array antenna adopting a plurality of U-slot patches as claimed in claim 1, wherein the shape of the first substrate or the second substrate is a circle, square, hexagon, or octagon.

5. A microstrip reflective array antenna adopting a plurality of U-slot patches as claimed in claim 1, wherein the lower surface of the second substrate further comprises one grounding layer.

6. A microstrip reflective array antenna adopting a plurality of U-slot patches as claimed in claim 5, wherein the grounding layer is a metal layer.

7. A microstrip reflective array antenna adopting a plurality of U-slot patches as claimed in claim 1, wherein each u-slot patch further electrically connects to a delay line.

* * * * *